US008835766B2

(12) United States Patent
Aoyama et al.

(10) Patent No.: US 8,835,766 B2
(45) Date of Patent: Sep. 16, 2014

(54) AUDIO/VIDEO CABLE

(75) Inventors: Seigi Aoyama, Kitaibaraki (JP); Toru Sumi, Hitachi (JP); Masayoshi Goto, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 285 days.

(21) Appl. No.: 13/317,462

(22) Filed: Oct. 19, 2011

(65) Prior Publication Data

US 2012/0097420 A1 Apr. 26, 2012

(30) Foreign Application Priority Data

Oct. 20, 2010 (JP) ..... 2010-235270

(51) Int. Cl.
*H01B 11/02* (2006.01)

(52) U.S. Cl.
USPC ..... 174/113 R

(58) Field of Classification Search
USPC ..... 174/113 R
See application file for complete search history.

(56) References Cited

U.S. PATENT DOCUMENTS

| | | | | |
|---|---|---|---|---|
| 4,863,804 | A * | 9/1989 | Whitlow et al. | 428/555 |
| 5,077,005 | A * | 12/1991 | Kato | 420/469 |
| 6,677,518 | B2 * | 1/2004 | Hirakawa et al. | 174/36 |
| 2007/0015001 | A1 * | 1/2007 | Uno et al. | 428/655 |

FOREIGN PATENT DOCUMENTS

JP 2002-363668 (A) 12/2002

* cited by examiner

*Primary Examiner* — Chau N Nguyen
(74) *Attorney, Agent, or Firm* — McGinn IP Law Group, PLLC

(57) ABSTRACT

An audio/video cable includes a plurality of parallel arranged insulated wires or twisted pair insulated wires each including a copper conductor and an insulation layer formed on a periphery thereof. The copper conductor includes a soft dilute copper alloy material containing pure copper, an additive element and an inevitable impurity as a balance. The soft dilute copper alloy material includes a recrystallized structure having a grain size distribution such that crystal grains in a surface layer are smaller than internal crystal grains. The surface layer includes a crystal structure such that an average crystal grain size from a surface of the surface layer up to a depth of 50 μm toward inside of the soft dilute copper alloy material is not more than 20 μm.

14 Claims, 17 Drawing Sheets

AUDIO/VIDEO CABLE

The present application is based on Japanese Patent Application No. 2010-235270 filed on Oct. 20, 2010, the entire contents of which are incorporated herein by reference.

BACKGROUND OF THE INVENTION

1. Field of the Invention

The invention relates to an audio/video cable.

2. Description of the Related Art

In recent science and technology, electricity is used for everything, such as for electric power as a drive source or for electric signal, and a conductor of a cable or a lead wire, etc., is used for transmission thereof. A metal having a high conductivity such as silver or copper, etc., is used as a material of the conductor, and especially a copper wire is used very often in view of the cost, etc.

Even though it is generically called copper, it is broadly classified into hard copper and soft copper depending on a molecular arrangement thereof. Copper of the type having desired properties is used depending on the purpose of use.

A hard copper wire is often used for a lead wire for electronic component but the rigid hard copper wire is not suitable as a cable used in electronic devices such as medical equipment, industrial robot or notebook computer since it is used in an environment where a combined external force of extreme bending, torsion and tension, etc., is repeatedly applied, and thus, a soft copper wire is used instead.

A conductor used for such a purpose is required to have contradictory characteristics, a good conductive property (high conductivity) and good bending characteristics, and thus, a copper material maintaining a high conductivity and flexibility has been developed.

For example, a flexible cable conductor having good tensile strength, elongation and conductivity is known in which a wire rod is formed of especially a copper alloy made of oxygen-free copper with a purity of not less than 99.99 wt % including 0.05 to 0.70 mass % of indium with a purity of not less than 99.99 wt % and 0.0001 to 0.003 mass % of P with a purity of not less than 99.9 wt % (see, e.g., JP-A 2002-363668).

An audio/video cable includes an audio cable, a video cable, a speaker cable, an S-terminal video cable, a D-terminal video cable and an HDMI cable, etc. For example, an audio cable is used for, e.g., reproducing stereophonic sound from a CD player through an amplifier. Meanwhile, a video cable is used for, e.g., reproducing video image and stereophonic sound from a DVD player or a video cassette recorder on a stereo television. In addition, a speaker cable is used for, e.g., reproducing sound from an amplifier through a speaker.

In addition, an S-terminal video cable is used for, e.g., reproducing an S-video image from a HDD/DVD recorder, etc., on a stereo television with an S-terminal, a D-terminal video cable is used for, e.g., reproducing a video image from a HDD/DVD recorder or a digital broadcast tuner on a stereo television with a D-terminal, and an HDMI cable is used for, e.g., reproducing a video image and sound from a HDD/DVD recorder with an HDMI terminal on a stereo television with an HDMI terminal.

The type of copper used for a conductor of such cables includes tough pitch copper (TPC), oxygen-free copper (OFC), linear crystal oxygen-free copper (LC-OFC), pure crystal oxygen free copper (PCOCC) and OFC with a purity of 99.9999% (6N) (6N-OFC), etc. There is an idea to use these materials for a hard copper wire. It is because it is considered that the sound and image quality is less deteriorated since the longer the average length of crystal grain, the less the transmission loss of a cable is.

SUMMARY OF THE INVENTION

In general, a length of a crystal grain in a hard copper wire is TPC, OFC, 6N-OFC, LC-OFC to PCOCC in this ascending order, however, a difference in length of crystal grain is not remarkable after being formed into a soft copper wire by heating. For example, a giant linear crystal structure in LC-OFC is destroyed by heating and is recrystallized into small crystal grains. It is generally said that the fewer the number of crystal grain boundaries, the less the transmission loss of a cable is and thus the sound and image quality is less deteriorated, hence, a conductor having a small number of crystal grain boundaries after being formed into a soft copper wire is required in view of improving the sound and image quality.

Meanwhile, in the form of a hard copper wire, deformation remains on the wire when, e.g., being wound around and drawn from a drawing capstan, and it is likely to be broken due to low elongation. Therefore, it is difficult to process a hard copper wire as a cable conductor.

For example, in case of using as a soft copper wire of OFC, etc., even though a crystal grain having a size within the acceptable range is obtained, it is necessary to increase a size of crystal grains and to reduce the number of crystal grain boundaries in order to further improve the sound quality, and a copper wire with a small number of crystal grain boundaries even in the form of a soft copper wire has been demanded.

Therefore, it is an object of the invention to provide an audio/video cable having a high conductivity and a long bending life even in the form of a soft copper member. In addition, it is another object of the invention to provide an audio/video cable which has a crystal structure with longer crystal grains than those in a copper wire of OFC, etc., and is excellent in flexibility even though it is a soft copper wire.

(1) According to one embodiment of the invention, an audio/video cable comprises:

a plurality of parallel arranged insulated wires each comprising a copper conductor and an insulation layer formed on a periphery thereof, wherein the copper conductor comprises a soft dilute copper alloy material containing pure copper, an additive element and an inevitable impurity as a balance, wherein the soft dilute copper alloy material comprises a recrystallized structure having a grain size distribution such that crystal grains in a surface layer are smaller than internal crystal grains, and wherein the surface layer comprises a crystal structure such that an average crystal grain size from a surface of the surface layer up to a depth of 50 μm toward inside of the soft dilute copper alloy material is not more than 20 μm.

(2) According to another embodiment of the invention, an audio/video cable comprises:

a plurality of twisted pair insulated wires each comprising a copper conductor and an insulation layer formed on a periphery thereof; and a jacket covering a periphery thereof, wherein the copper conductor comprises a soft dilute copper alloy material containing pure copper, an additive element and an inevitable impurity as a balance, wherein the soft dilute copper alloy material comprises a recrystallized structure having a grain size distribution such that crystal grains in a surface layer are smaller than internal crystal grains, and wherein the surface layer comprises a crystal structure such that an average crystal grain size from a surface of the surface layer up to a depth of 50 μM toward inside of the soft dilute copper alloy material is not more than 20 μm.

In the above embodiment (1) or (2) of the invention, the following modifications and changes can be made.

(i) The additive element is selected from the group consisting of Ti, Mg, Zr, Nb, Ca, V, Ni Mn and Cr.

(ii) The Ti in the form of any one of TiO, $TiO_2$, TiS or Ti—O—S is included in a crystal grain or at crystal grain boundary of the pure copper.

(iii) The soft dilute copper alloy material includes not less than 2 and not more than 12 mass ppm of sulfur, more than 2 mass ppm but not more than 30 mass ppm of oxygen and not less than 4 and not more than 55 mass ppm of Ti.

Effects of the Invention

According to one embodiment of the invention, an audio/video cable can be provided that has a high conductivity and a long bending life even in the form of a soft copper member. In addition, an audio/video cable can be provided that has a crystal structure with longer crystal grains than those in a copper wire of OFC, etc., and is excellent in flexibility even though it is a soft copper wire.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
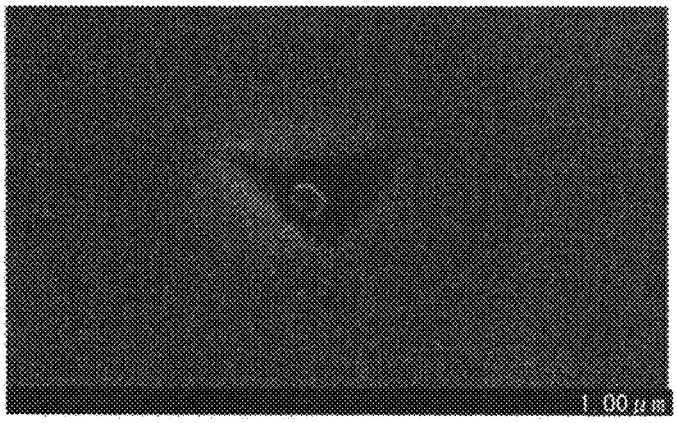
FIG. 1 is an SEM image showing TiS particle.

An audio/video cable in the present embodiment is formed using a soft dilute copper alloy material as a soft copper material which satisfies a conductivity of not less than 98% IACS (International Annealed Copper Standard, conductivity is defined as 100% when resistivity is $1.7241\times10^{-8}$ Ωm), preferably not less than 100% IACS, and more preferably not less than 102% IACS.

In addition, the audio/video cable in the present embodiment can be stably produced in a wide range of manufacturing with less generation of surface flaws by using a SCR continuous casting equipment. In addition, a material having a softening temperature of not more than 148° C. when a compression ratio of a wire rod is 90% (e.g., processing from a 8 mm diameter wire into a 2.6 mm diameter wire) is used to form the audio/video cable.

In detail, an audio/video cable in the present embodiment has plural insulated wires arranged in parallel each of which is composed of a copper conductor and an insulation layer formed on an outer periphery thereof, and the copper conductor is formed of a soft dilute copper alloy material containing pure copper, a trace amount of additive element and inevitable impurities as a balance. The soft dilute copper alloy material has a recrystallized structure having a grain size distribution in which crystal grains in a surface layer are smaller than internal crystal grains, and the surface layer has a crystal structure in which the average crystal grain size from a surface of the surface layer up to a depth of 50 μm toward inside of the soft dilute copper alloy material is not more than 20 μm. Here, "a crystal grain" means a crystal structure of copper.

Meanwhile, an audio/video cable in another aspect of the present embodiment has plural twisted pair insulated wires each of which is composed of a copper conductor and an insulation layer formed on an outer periphery thereof and a jacket covering an outer periphery of the insulated wires, and the copper conductor is formed of a soft dilute copper alloy material containing pure copper, an additive element and inevitable impurities as a balance. The soft dilute copper alloy material has a recrystallized structure having a grain size distribution in which crystal grains in a surface layer are smaller than internal crystal grains, and the surface layer has a crystal structure in which the average crystal grain size from a surface of the surface layer up to a depth of 50 μm toward inside of the soft dilute copper alloy material is not more than 20 μm.

Here, the additive element is selected from the group consisting of Ti, Mg, Zr, Nb, Ca, V, Ni Mn and Cr. The reason why element(s) selected from the group consisting of Ti, Mg, Zr, Nb, Ca, V, Ni Mn and Cr is selected as an additive element is that these elements are active elements which are likely to bind to other elements and thus likely to bind to S, which allows S to be trapped and a copper base material (matrix) to be highly purified. One or more additive elements may be contained. Alternatively, other elements or impurities which do not adversely affect the properties of an alloy may be contained in the alloy. In addition, although it is explained in the preferred embodiment below that the favorable oxygen content is more than 2 but not more than 30 mass ppm, oxygen can be included in an amount of more than 2 but not more than 400 mass ppm within a range providing the properties of the alloy, depending on the added amount of the additive element and the S content. In addition, the Ti is included in the form of any one of TiO, $TiO_2$, TiS or Ti—O—S and is precipitated in a crystal grain or at crystal grain boundary of pure copper.

In addition, the soft dilute copper alloy material includes not less than 2 mass ppm and not more than 12 mass ppm of sulfur, more than 2 mass ppm but not more than 30 mass ppm of oxygen and not less than 4 and not more than 55 mass ppm of titanium. The object used in the present embodiment includes more than 2 mass ppm but not more than 30 mass ppm of oxygen, hence, is so-called low-oxygen copper (LOC).

The points studied by the inventors to realize an audio/video cable in the present embodiment will be explained below.

The softening temperature at the compression ratio of 90% is 130° C. for high purity copper with a purity of 6N (i.e., 99.9999%). Therefore, the inventors examined a soft dilute copper alloy material which allows stable manufacturing of soft copper having a softening temperature of not less than 130° C. and not more than 148° C. as a temperature allowing stable manufacturing and a conductivity of not less than 98% IACS, preferably not less than 100% IACS, and more preferably not less than 102% IACS, and a method of manufacturing the soft dilute copper alloy material.

Here, high purity copper (4N) with an oxygen concentration of 1 to 2 mass ppm is prepared and molten metal of Cu is made therefrom by using a small continuous casting machine placed in an experimental laboratory. Then, several mass ppm of titanium is added to the molten metal. Following this, a 8 mm diameter wire rod is formed from the molten metal having titanium added thereto. Next, the 8 mm diameter wire rod is processed to have 2.6 mm diameter (i.e., at a compression ratio of 90%). The softening temperature of the 2.6 mm diameter wire rod is 160 to 168° C. and cannot be lower than this temperature. In addition, the conductivity of the 2.6 mm diameter wire rod is about 101.7% IACS. That is, the inventors found that, even though the oxygen concentration in the wire rod is reduced and titanium is added to the molten metal, it is not possible to lower the softening temperature of the wire rod and the conductivity is lower than that of high purity copper (6N) which is 102.8% IACS.

It is presumed that the softening temperature is not lowered and the conductivity is lower than that of 6N high purity copper because several mass ppm or more of sulfur (S) is mixed as inevitable impurity during manufacturing of the molten metal. That is, it is presumed that the softening temperature of the wire rod is not lowered since sulfide such as TiS, etc., is not sufficiently formed by sulfur and titanium which are included in the molten metal.

Accordingly, the inventors examined following two measures in order to lower the softening temperature of the soft dilute copper alloy material and to improve the conductivity thereof. Then, the soft dilute copper alloy material constituting the audio/video cable in the present embodiment is obtained by combining the following two measures to manufacture a wire rod.

Figure 2:
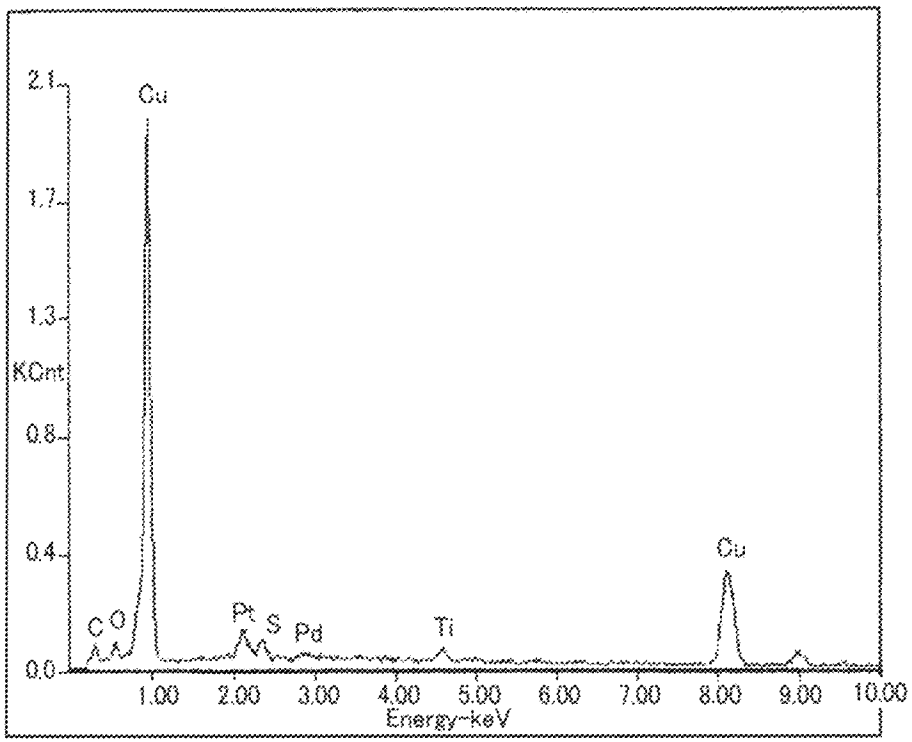
FIG. 2 is a graph showing a result of analysis of FIG. 1.
Figure 3:
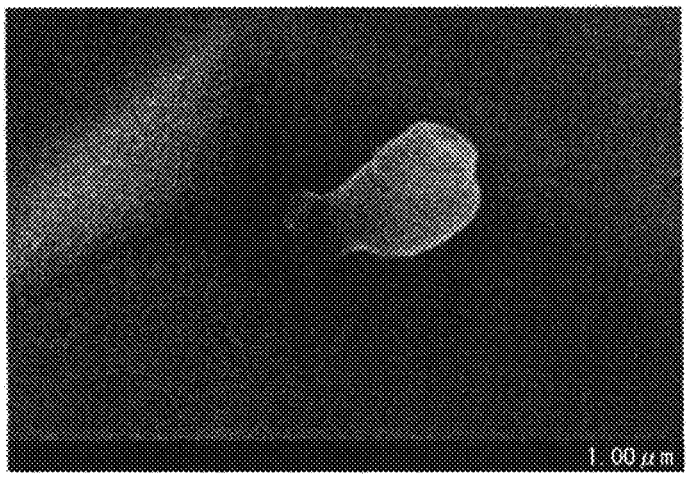
FIG. 3 is an SEM image showing $TiO_2$ particle.
Figure 4:
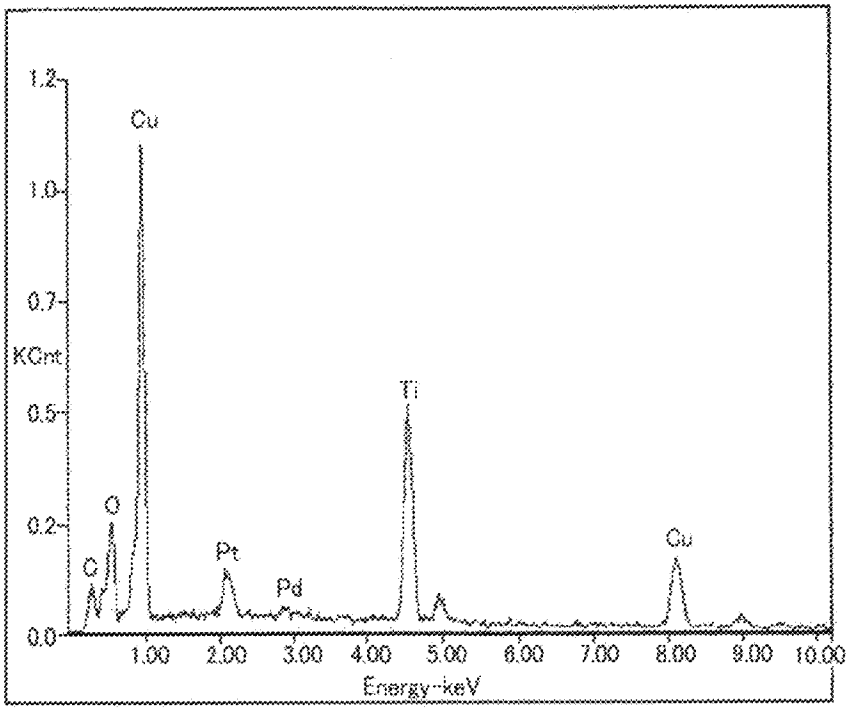
FIG. 4 is a graph showing a result of analysis of FIG. 3.
Figure 5:
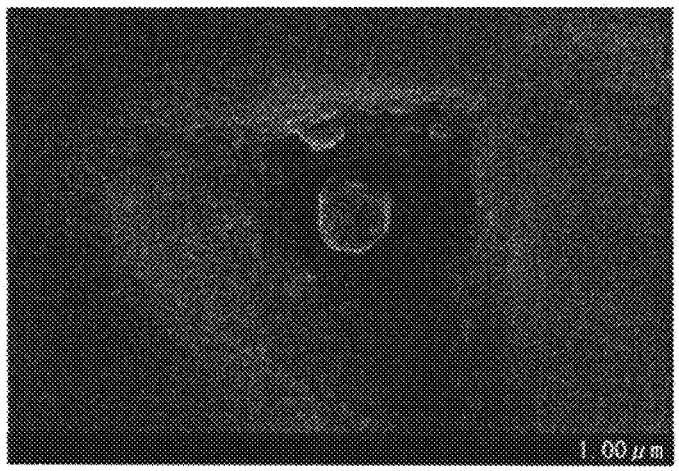
FIG. 5 is an SEM image showing Ti—O—S particle.
Figure 6:
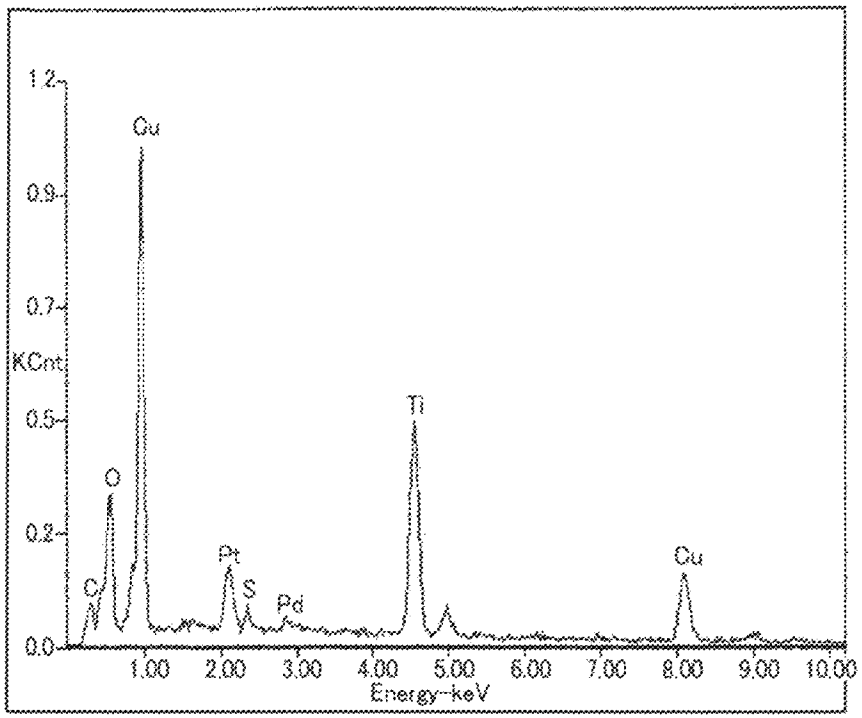
FIG. 6 is a graph showing a result of analysis of FIG. 5.

FIG. 1 is an SEM image of TiS particle and FIG. 2 shows a result of analysis of FIG. 1. Then, FIG. 3 is an SEM image of $TiO_2$ particle and FIG. 4 shows a result of analysis of FIG. 3. Furthermore, FIG. 5 is an SEM image of Ti—O—S particle and FIG. 6 shows a result of analysis of FIG. 5. Note that, each particle is seen near the center of the SEM image. In FIGS. 1 to 6, a cross section of a 8 mm diameter copper wire (wire rod) having an oxygen concentration, a Ti concentration and a sulfur concentration which are shown in the third row of Example 1 in Table 1 is evaluated by an SEM observation and an EDX analysis. The observation conditions are an acceleration voltage of 15 keV and an emission current of 10 μA.

Firstly, as the first measure, molten metal of copper is made in a state that titanium (Ti) is added to Cu having an oxygen concentration of more than 2 mass ppm. It is considered that TiS, titanium oxide (e.g., $TiO_2$) and Ti—O—S particles are formed in the molten metal. This is observed in the SEM image of FIG. 1, the result of analysis in FIG. 2, the SEM image of FIG. 3 and the result of analysis in FIG. 4. It should be noted that Pt and Pd in FIGS. 2, 4 and 6 are metal elements deposited on an object to be observed under the SEM observation.

Next, as the second measure, a temperature during the hot rolling process is set to be lower (880 to 550° C.) than the temperature under the typical manufacturing conditions of copper (i.e., 950 to 600° C.) for the purpose that dislocation is introduced into copper for easy precipitation of sulfur (S). Such a temperature setting allows S to be precipitated on the dislocation or to be precipitated using titanium oxide (e.g., $TiO_2$) as a nucleus. For example, Ti—O—S particles, etc., are formed at the same time as the formation of the molten copper, as shown in FIGS. 5 and 6.

Since the sulfur included in the copper is crystallized and precipitated by the first and second measures described above, a copper wire rod which has the desired softening temperature and the desired conductivity can be obtained after a cold wire drawing process.

Meanwhile, the soft dilute copper alloy material constituting the audio/video cable in the present embodiment is manufactured using a SCR continuous casting and rolling equipment. Here, the following three conditions are set as a limitation of the manufacturing conditions in case of using the SCR continuous casting and rolling equipment.

(1) Composition

In order to obtain a soft copper material having a conductivity of not less than 98% IACS, a soft dilute copper alloy material using pure copper with inevitable impurities (as a base material) and including 3 to 12 mass ppm of sulfur, more than 2 but not more than 30 mass ppm of oxygen and 4 to 55 mass ppm of titanium is used, and then, a wire rod (a roughly drawing wire) is manufactured using the soft dilute copper alloy material.

Here, in order to obtain a soft copper material having a conductivity of not less than 100% IACS, a soft dilute copper alloy material using pure copper with inevitable impurities (as a base material) and including 2 to 12 mass ppm of sulfur, more than 2 but not more than 30 mass ppm of oxygen and 4 to 37 mass ppm of titanium is used. In addition, in order to obtain a soft copper material having a conductivity of not less than 102% IACS, a soft dilute copper alloy material using pure copper with inevitable impurities (as a base material) and including 3 to 12 mass ppm of sulfur, more than 2 but not more than 30 mass ppm of oxygen and 4 to 25 mass ppm of titanium is used.

In the industrial production of pure copper, sulfur is generally introduced into copper during the manufacturing of electrolytic copper, and it is thus difficult to adjust sulfur to be not more than 3 mass ppm. The upper limit of the sulfur concentration for general-purpose electrolytic copper is 12 mass ppm.

An oxygen concentration is controlled to be more than 2 mass ppm since the softening temperature of the soft dilute copper alloy material constituting the audio/video cable is less likely to decrease when the oxygen concentration is low. On the other hand, since flaws are likely to be generated on the surface of the soft dilute copper alloy material constituting the audio/video cable during the hot rolling process when the oxygen concentration is high, the oxygen concentration is controlled to be not more than 30 mass ppm.

(2) Dispersed Substance

It is preferable that the dispersed particle in the soft dilute copper alloy material constituting the audio/video cable be small in size and large in number. The reason thereof is that the dispersed particle has a function as a precipitation site of sulfur and the precipitation site is required to be small in size and large in number.

Sulfur and titanium are included in the soft dilute copper alloy material constituting the audio/video cable in the form of TiO, $TiO_2$, TiS or a compound having a Ti—O—S bond, or aggregates thereof, and the rest of Ti and S are included as a solid solution. A soft dilute copper alloy material constituting the audio/video cable, in which TiO of not more than 200 nm in size, $TiO_2$ of not more than 1000 nm in size, TiS of not more than 200 nm in size and the compound in the form of Ti—O—S of not more than 300 nm in size are distributed in a crystal grain, is used.

Note that, since the size of particle formed in the crystal grain varies depending on holding time and a cooling condition of the molten copper during the casting, the casting conditions are also appropriately determined.

(3) Casting Conditions

A wire rod is made by the SCR continuous casting and rolling, where a compression ratio for processing an ingot rod is 90% (30 mm) to 99.8% (5 mm). As an example, a condition to manufacture a 8 mm diameter wire rod at a compression ratio of 99.3% is employed. The casting conditions (a) and (b) will be explained below.

Casting Condition (a)

The molten copper temperature in the melting furnace is controlled to be not less than 1100° C. and not more than 1320° C. It is controlled to be not more than 1320° C. since there is a tendency that a blow hole is increased, a flaw is generated and a particle size is enlarged when the temperature of the molten copper is high. Although the reason for controlling the temperature to be not less than 1100° C. is that copper is likely to solidify and the manufacturing is not stable, the molten copper temperature is desirably as low as possible.

Casting Condition (b)

The temperature during the hot rolling process is controlled to be not more than 880° C. at the initial roll and not less than 550° C. at the final roll.

Unlike the typical manufacturing conditions of pure copper, it is preferable to determine the temperature of the molten copper and the temperature during the hot rolling process to be the conditions described in "the casting conditions (a) and (b)" in order to further decrease a solid solubility limit which is an activation energy to crystallize sulfur in the molten copper and to precipitate the sulfur during the hot rolling.

In addition, the typical temperature during the hot rolling process is not more than 950° C. at the initial roll and not less than 600° C. at the final roll, however, in order to further decrease the solid solubility limit, the temperature in the present embodiment is determined to be not more than 880° C. at the initial roll and not less than 550° C. at the final roll.

The reason why the temperature at the final roll is determined to be not less than 550° C. is that there are many flaws on the obtained wire rod at a temperature of less than 550° C. and the manufactured soft dilute copper alloy material for constituting the audio/video cable cannot be treated as a commercial product. The temperature during the hot rolling process is controlled to be not more than 880° C. at the initial roll and not less than 550° C. at the final roll, and is preferably as low temperature as possible. Such a temperature setting allows the softening temperature of the soft dilute copper alloy material constituting the audio/video cable (the softening temperature after being processed from 8 into 2.6 mm diameter) to be close to that of 6N copper (i.e., 130° C.).

The conductivity of oxygen-free copper is about 101.7% IACS and that of 6N copper is 102.8% IACS. In the present embodiment, a wire rod with a diameter of, e.g., 8 mm has a conductivity of not less than 98% IACS, preferably not less than 100% IACS, and more preferably not less than 102% IACS. In addition, in the present embodiment, a soft dilute copper alloy is manufactured such that a wire rod as a wire material after the cold wire drawing process (e.g., 2.6 mm diameter) has a softening temperature of not less than 130° C. and not more than 148° C., and the soft dilute copper alloy is used to manufacture an audio/video cable.

For the industrial use, a conductivity of not less than 98% IACS is required for the soft copper wire manufactured from electrolyte copper with industrially usable purity. In addition, the softening temperature should be not more than 148° C. in light of the industrial value thereof. Since the softening temperature of 6N copper is 127 to 130° C., the upper limit of the softening temperature is determined to be 130° C. based on the obtained data. This slight difference is caused by a presence of inevitable impurity which is not included in 6N copper.

It is preferable that the copper as a base material be melted in a shaft furnace and be subsequently poured into a ladle in a reduced-state. That is, it is preferable that a wire rod be stably manufactured by casting and rolling the material in a reductive gas (e.g., CO) atmosphere while controlling concentrations of sulfur, titanium and oxygen of a dilute alloy. Note that, mixture of copper oxide and/or a particle size larger than a predetermined size cause deterioration in the quality of the audio/video cable to be manufactured.

Here, the reason why titanium is added as an additive to the soft dilute copper alloy material constituting the audio/video cable is as follows. That is, (a) titanium is likely to form a compound by binding to sulfur in the molten copper, (b) it is easy to process and handle compared to other added metals such as Zr, (c) it is cheaper than Nb, etc., and (d) it is likely to be precipitated using oxide as a nucleus.

As described above, a practical soft dilute copper alloy material having high productivity and excellent in conductivity, softening temperature and surface quality can be obtained as a raw material of the soft dilute copper alloy material constituting the audio/video cable in the present embodiment. In addition, a plating layer may be formed on a surface of the soft dilute copper alloy material. For example, a material consisting mainly of tin, nickel and silver, or Pb-free plating can be used for the plating layer.

In addition, it is possible to use a soft dilute copper alloy twisted wire which is formed by twisting plural soft dilute copper alloy wires in the present embodiment.

In addition, a wire rod is formed by the SCR continuous casting and rolling method and a soft material is formed by the hot rolling in the present embodiment, however, it is possible to use a twin-roll continuous casting and rolling method or a Properzi continuous casting and rolling method.

Effects of the Embodiment

The audio/video cable of the present embodiment has a high conductivity and a long bending life. In addition, the audio/video cable of the present embodiment has a crystal structure with larger crystal grains than those in a copper wire of OFC, etc., and is excellent in flexibility even though it is a soft copper wire.

Table 1 shows experimental conditions and results.

TABLE 1

| Experimental material | Oxygen concentration (mass ppm) | S concen-tration (mass ppm) | Ti concen-tration (mass ppm) | 2.6 mm diameter Semi-softening temperature (° C.) | | 2.6 mm diameter Conductivity of soft material (% IACS) | Evaluation of dispersed particle size | Overall evaluation |
|---|---|---|---|---|---|---|---|---|
| Comparative Example 1 | 1 to less than 2 | 5 | 0 | 215 | X | 101.7 | ○ | X |
| (small continuous casting | 1 to less than 2 | 5 | 7 | 168 | X | 101.5 | ○ | X |
| machine) | 1 to less than 2 | 5 | 13 | 160 | X | 100.9 | ○ | X |
| | 1 to less than 2 | 5 | 15 | 173 | X | 100.5 | ○ | X |
| | 1 to less than 2 | 5 | 18 | 190 | X | 99.6 | ○ | X |
| Comparative Example 2 | 7 to 8 | 3 | 0 | 164 | X | 102.2 | ○ | X |
| (SCR) | 7 to 8 | 5 | 2 | 157 | X | 102.1 | ○ | X |
| Example 1 | 7 to 8 | 5 | 4 | 148 | ○ | 102.1 | ○ | ○ |
| (SCR) | 7 to 8 | 5 | 10 | 135 | ○ | 102.2 | ○ | ○ |
| | 7 to 8 | 5 | 13 | 134 | ○ | 102.4 | ○ | ○ |
| | 7 to 8 | 5 | 20 | 130 | ○ | 102.2 | ○ | ○ |
| | 7 to 8 | 5 | 25 | 132 | ○ | 102.0 | ○ | ○ |
| | 7 to 8 | 5 | 37 | 134 | ○ | 101.1 | ○ | ○ |
| | 7 to 8 | 5 | 40 | 135 | ○ | 99.6 | ○ | ○ |
| | 7 to 8 | 5 | 55 | 148 | ○ | 98.2 | ○ | ○ |
| Comparative Example 3 | 7 to 8 | 5 | 60 | 155 | X | 97.7 | X | X |
| (SCR) | | | | | | | Poor surface quality | |
| Example 2 | Difficult to | 5 | 13 | 145 | ○ | 102.1 | ○ | Δ |
| (SCR) | control stability at less than 2 | | | | | | | |
| | More than 2 but not more than 3 | 5 | 11 | 133 | ○ | 102.2 | ○ | ○ |
| | 3 | 5 | 12 | 133 | ○ | 102.2 | ○ | ○ |
| | 30 | 5 | 10 | 134 | ○ | 102.0 | ○ | ○ |
| Comparative Example 4 | 40 | 5 | 14 | 134 | ○ | 101.8 | X | X |
| (SCR) | | | | | | | Poor surface quality | |
| Example 3 | 7 to 8 | 2 | 4 | 134 | ○ | 102.2 | ○ | ○ |
| (SCR) | 7 to 8 | 10 | 13 | 135 | ○ | 102.3 | ○ | ○ |
| | 7 to 8 | 12 | 14 | 136 | ○ | 102.2 | ○ | ○ |
| | 7 to 8 | 11 | 19 | 133 | ○ | 102.4 | ○ | ○ |
| | 7 to 8 | 12 | 20 | 133 | ○ | 102.4 | ○ | ○ |
| Comparative Example 5 | 7 to 8 | 18 | 13 | 162 | X | 101.5 | ○ | X |
| Comparative Example 6 (Cu (6N)) | | | | 127 to 130 | ○ | 102.8 | None | — |

Firstly, an 8 mm diameter copper wire (a wire rod, at a compression ratio of 99.3%) having concentrations of oxygen, sulfur and titanium shown in Table 1 was made as an experimental material. The 8 mm diameter copper wire has been hot rolled by SCR continuous casting and rolling. Copper molten metal which was melted in a shaft furnace was poured into a ladle under a reductive gas atmosphere, the copper molten metal poured into the ladle was introduced into a casting pot under the same reductive gas atmosphere, and after Ti was added in the casting pot, the resulting molten copper was introduced through a nozzle into a casting mold formed between a casting wheel and an endless belt, thereby making an ingot rod. The 8 mm diameter copper wire was made by hot rolling the ingot rod. Next, each experimental material was cold-drawn. As a result, a copper wire having a diameter of 2.6 mm was made. Then, the semi-softening temperature and the conductivity of the 2.6 mm diameter copper wire were measured, and the dispersed particle size in the 8 mm diameter copper wire was evaluated.

The oxygen concentration was measured by an oxygen analyzer (Leco oxygen analyzer (Leco: registered trademark)). Each concentration of sulfur and titanium was analyzed by an ICP emission spectrophotometer.

After holding for one hour at each temperature of not more than 400° C., water quenching and a tensile test were carried out, and the measurement result of the semi-softening temperature of 2.6 mm diameter wire was obtained. It was obtained by using the result of the tensile test at a room temperature and the result of the tensile test of the soft copper wire which was heat-treated in an oil bath at 400° C. for one hour, and the temperature corresponding to a strength value calculated by adding the two tensile strength results in the tensile test and then dividing by two was defined as a semi-softening temperature.

As described for the embodiment, it is preferable that the dispersed particles in the soft dilute copper alloy wire be small in size and large in number. Therefore, it is judged as "Passed" when not less than 90% of dispersed particles have a diameter of not more than 500 nm. "Size", as described here, is a size of a compound and means a size of a long diameter of the compound in a shape having long and short diameters. Meanwhile, "particle" indicates TiO, $TiO_2$, TiS and Ti—O—S. In addition, "90%" indicates a ratio of the number of such particles to the total number of particles.

In Table 1, Comparative Example 1 is a copper wire having a diameter of 8 mm which was experimentally formed under Ar atmosphere in the experimental laboratory and in which 0 to 18 mass ppm of Ti was added thereto. In contrast to the case that the semi-softening temperature of the copper wire without addition of Ti thereto is 215° C., the semi-softening temperature of the copper wire with 13 mass ppm of Ti added thereto was lowered to 160° C. (the minimum temperature in the tests in Comparative Example 1). As shown in Table 1, the semi-softening temperature was increased with increasing the Ti concentration from 15 to 18 mass ppm, and it was not possible to realize the required semi-softening temperature of not less than 148° C. In addition, although the conductivity was not less than 98% IACS which satisfies the industrial demand, the overall evaluation was "Failed" (hereinafter, "Failed" is indicated by "X").

Then, as Comparative Example 2, the oxygen concentration was adjusted to be 7 to 8 mass ppm and a 8 mm diameter copper wire (wire rod) was experimentally formed using the SCR continuous casting and rolling method.

Among the copper wires experimentally formed using the SCR continuous casting and rolling method, the copper wire of Comparative Example 2 has the minimum Ti concentration (i.e., 0 mass ppm and 2 mass ppm) and the conductivity was not less than 102% IACS. However, the semi-softening temperature is 164° C. and 157° C. which is not the demanded temperature of not more than 148° C., hence, the overall evaluation is "X".

In Example 1, copper wires having substantially the same concentrations of oxygen and sulfur (i.e., the oxygen concentration of 7 to 8 mass ppm and the sulfur concentration of 5 mass ppm) but having a Ti concentration differed within a range of 4 to 55 mass ppm were experimentally formed.

The Ti concentration in the range of 4 to 55 mass ppm is satisfactory because the softening temperature is not more than 148° C., the conductivity is not less than 98% IACS or not less than 102% IACS and the dispersed particle size is not more than 500 nm in not less than 90% of particles. In addition, since the surface of the wire rod is also fine and all materials satisfy the product performances thereof, the overall evaluation is "Passed" (hereinafter, "Passed" is indicated by "○").

Here, the copper wire which satisfies the conductivity of not less than 100% IACS has the Ti concentration of 4 to 37 mass ppm and the copper wire which satisfies not less than 102% IACS has the Ti concentration of 4 to 25 mass ppm. The conductivity of 102.4% IACS which is the maximum value was exhibited when the Ti concentration is 13 mass ppm, and the conductivity at around this concentration was a slightly lower value. This is because, when the Ti concentration is 13 mass ppm, sulfur in copper is trapped as a compound, and thus, the conductivity close to that of high purity copper (6N) is exhibited.

Therefore, it is possible to satisfy both of the semi-softening temperature and the conductivity by increasing the oxygen concentration and adding Ti.

In Comparative Example 3, a copper wire in which the Ti concentration is increased to 60 mass ppm was experimentally formed. The copper wire in Comparative Example 3 satisfies the demanded conductivity, however, the semi-softening temperature is not less than 148° C., which does not satisfy the product performance. Furthermore, there were many surface flaws on the wire rod, hence, it was difficult to treat as a commercial product. Therefore, it was shown that the preferable added amount of Ti is less than 60 mass ppm.

Regarding the copper wire of Example 2, the sulfur concentration was set to be 5 mass ppm and the Ti concentration was controlled in a range of 13 to 10 mass ppm, and the affect of the oxygen concentration was examined by changing the oxygen concentration.

Copper wires having largely different oxygen concentrations within a range from more than 2 mass ppm to not more than 30 mass ppm were made. However, since the copper wire having the oxygen concentration of less than 2 mass ppm is difficult to produce and cannot be stably manufactured, the overall evaluation is Δ (not good). (Not that, "Δ" is between "○" and "X" as an evaluation.) In addition, the requirements of both the semi-softening temperature and the conductivity are satisfied even when the oxygen concentration is increased to 30 mass ppm.

In Comparative Example 4, when the oxygen concentration was 40 mass ppm, there were many flaws on the surface of the wire rod and it was in a condition which cannot be a commercial product.

Therefore, it was shown that, by adjusting the oxygen concentration so as to fall within a range of more than 2 but not more than 30 mass ppm, it is possible to satisfy all characteristics of the semi-softening temperature, conductivity of not less than 102% IACS and the dispersed particle size, and in addition, the surface of the wire rod is fine and the product performance can be satisfied.

Example 3 is a copper wire in which the oxygen concentration is relatively close to the Ti concentration and the sulfur concentration is changed in a range from 2 to 12 mass ppm. In Example 3, it was not possible to realize a copper wire having the sulfur concentration of less than 2 mass ppm due to limitation of raw material. However, it is possible to satisfy the requirements of both the semi-softening temperature and the conductivity by respectively controlling the concentrations of Ti and sulfur.

Comparative Example 5, in which the sulfur concentration is 18 mass ppm and the Ti concentration is 13 mass ppm, has a high semi-softening temperature of 162° C. and could not satisfy requisite characteristics. In addition, the surface quality of the wire rod is specifically poor, and it was thus difficult to commercialize.

As described above, it was shown that all characteristics which are the semi-softening temperature, not less than 102% IACS of conductivity and the dispersed particle size can be satisfied when the sulfur concentration is 2 to 12 mass ppm, the surface of the wire rod is also fine and the product performances can be satisfied.

Comparative Example 6 is a copper wire using 6N copper. In the copper wire of Comparative Example 6, the semi-softening temperature was 127 to 130° C., the conductivity was 102.8% IACS and particles having not more than 500 nm in the dispersed particle size were not observed at all.

Table 2 shows a molten copper temperature and a rolling temperature as the manufacturing conditions.

TABLE 2

| Experimental material | Molten copper temperature (° C.) | Oxygen concentration (mass ppm) | S concentration (mass ppm) | Ti concentration (mass ppm) | Hot-rolling temperature (° C.) Initial-Final | 2.6 mm diameter semi-softening temperature (° C.) | 2.6 mm diameter conductivity of soft material (% IACS) | WR surface quality | Evaluation of dispersed particle size | Overall evaluation |
|---|---|---|---|---|---|---|---|---|---|---|
| Comparative | 1350 | 15 | 7 | 13 | 950-600 | 148 | 101.7 | X | X | X |
| Example 7 | 1330 | 16 | 6 | 11 | 950-600 | 147 | 101.2 | X | X | X |
| Example 4 | 1320 | 15 | 5 | 13 | 880-550 | 143 | 102.1 | ○ | ○ | ○ |
| | 1300 | 16 | 6 | 13 | 880-550 | 141 | 102.3 | ○ | ○ | ○ |
| | 1250 | 15 | 6 | 14 | 880-550 | 138 | 102.1 | ○ | ○ | ○ |
| | 1200 | 15 | 6 | 14 | 880-550 | 135 | 102.1 | ○ | ○ | ○ |
| Comparative Example 8 | 1100 | 12 | 5 | 12 | 880-550 | 135 | 102.1 | X | ○ | X |

TABLE 2-continued

| Experimental material | Molten copper temperature (° C.) | Oxygen concen-tration (mass ppm) | S concen-tration (mass ppm) | Ti concen-tration (mass ppm) | Hot-rolling temperature (° C.) Initial-Final | 2.6 mm diameter semi-softening temperature (° C.) | 2.6 mm diameter conductivity of soft material (% IACS) | WR surface quality | Evaluation of dispersed particle size | Overall evaluation |
|---|---|---|---|---|---|---|---|---|---|---|
| Comparative Example 9 | 1300 | 13 | 6 | 13 | 950-600 | 147 | 101.5 | ○ | X | X |
| Comparative Example 10 | 1350 | 14 | 6 | 12 | 880-550 | 149 | 101.5 | X | X | X |

In Comparative Example 7, a 8 mm diameter wire rod was made at the molten copper temperature of 1330 to 1350° C. and at the rolling temperature of 950 to 600° C. Although the wire rod in Comparative Example 7 satisfies the requirements of the semi-softening temperature and the conductivity, there are particles having a dispersed particle size of about 1000 nm and the presence of particles having a particle size of not less than 500 nm was more than 10%. Therefore, the wire rod in Comparative Example 7 was judged as inapplicable.

In Example 4, a 8 mm diameter wire rod was made by controlling the molten copper temperature in a range of 1200 to 1320° C. and the rolling temperature in a range of 880 to 550° C. The wire rod in Example 4 was satisfactory in the surface quality and the dispersed particle size, and the overall evaluation was "○".

In Comparative Example 8, a 8 mm diameter wire rod was made by controlling the molten copper temperature to be 1100° C. and the rolling temperature in a range of 880 to 550° C. The wire rod in Comparative Example 8 was not suitable as a commercial product since there were many surface flaws thereon due to the low molten copper temperature. This is because the flaws are likely to be generated at the time of rolling since the molten copper temperature is low.

In Comparative Example 9, a 8 mm diameter wire rod was made by controlling the molten copper temperature to be 1300° C. and the rolling temperature in a range of 950 to 600° C. The wire rod in Comparative Example 9 has satisfactory surface quality since the temperature during the hot rolling process is high, however, the dispersed particles large in size are included and the overall evaluation is "X".

In Comparative Example 10, a 8 mm diameter wire rod was made by controlling the molten copper temperature to be 1350° C. and the rolling temperature in a range of 880 to 550° C. In the wire rod in Comparative Example 10, the large dispersed particles are included since the molten copper temperature is high, and the overall evaluation is "X".

Softening Characteristics of Soft Dilute Copper Alloy Wire

A wire rod in Comparative Example 11 using oxygen-free copper and a wire rod in Example 5 formed using a soft dilute copper alloy wire formed of low-oxygen copper including 13 mass ppm of Ti were annealed at different annealing temperatures for 1 hour and then Vickers hardness (Hv) thereof was measured, and the results are shown in Table 3.

TABLE 3

| | 20° C. | 400° C. | 600° C. |
|---|---|---|---|
| Example 5 | 120 | 52 | 48 |
| Comparative Example 11 | 124 | 53 | 56 |

(Unit: Hv)

The wire rod in Example 5 has the same alloy composition as that described in Example 1 of Table 1. In addition, the sample used here has a diameter of 2.6 mm. According to Table 3, it is shown that Vickers hardness (Hv) of the wire rod in Comparative Example 11 is at the equivalent level to that in Example 5 at the annealing temperature of 400° C., as well as at the annealing temperature of 600° C. Accordingly, it is shown that the wire rod in Example 5 has sufficient softening characteristics and exhibits excellent softening characteristics especially in the annealing temperature range of more than 400° C., from comparison to an oxygen-free copper wire.

Examination of Proof Stress and Bending Life of Soft Dilute Copper Alloy Wire

A wire rod in Comparative Example 12 using oxygen-free copper and a wire rod in Example 6 formed using a soft dilute copper alloy wire formed of low-oxygen copper including 13 mass ppm of Ti were annealed at different annealing temperatures for 1 hour and then variation in a 0.2% proof stress value thereof was measured, and the results are shown in Table 4. The sample used here has a diameter of 2.6 mm. In addition, the wire rod in Example 6 has the same alloy composition as that described in Example 1 of Table 1.

TABLE 4

| | 20° C. | 250° C. | 400° C. | 600° C. | 700° C. |
|---|---|---|---|---|---|
| Example 6 | 421 | 80 | 58 | 35 | 25 |
| Comparative Example 12 | 412 | 73 | 53 | 32 | 24 |

(Unit: MPa)

Table 4 shows that the 0.2% proof stress value of the wire rod in Comparative Example 12 and that of the wire rod in Example 6 are at the equivalent level at the annealing temperature of 400° C. as well as at the annealing temperature of 600° C.

Figure 7:
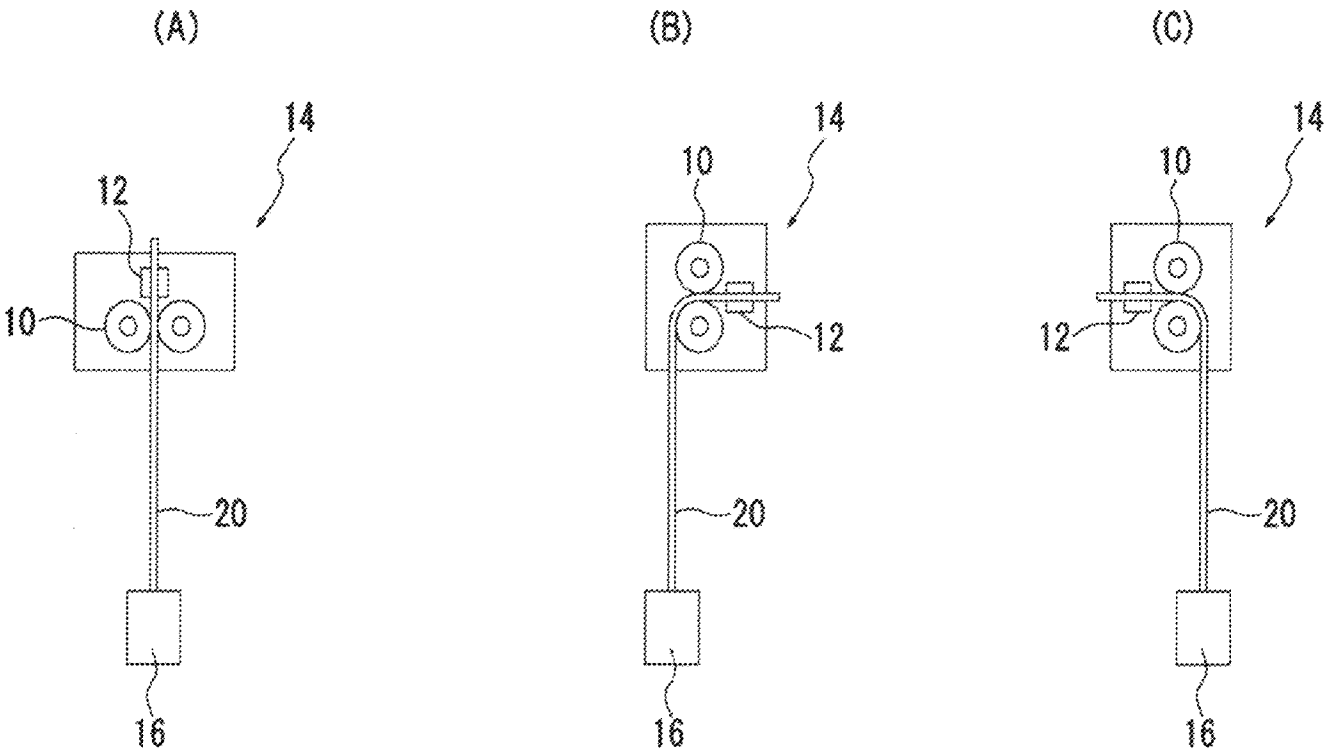
FIG. 7 is a schematic view showing a bending fatigue test.
Figure 8:
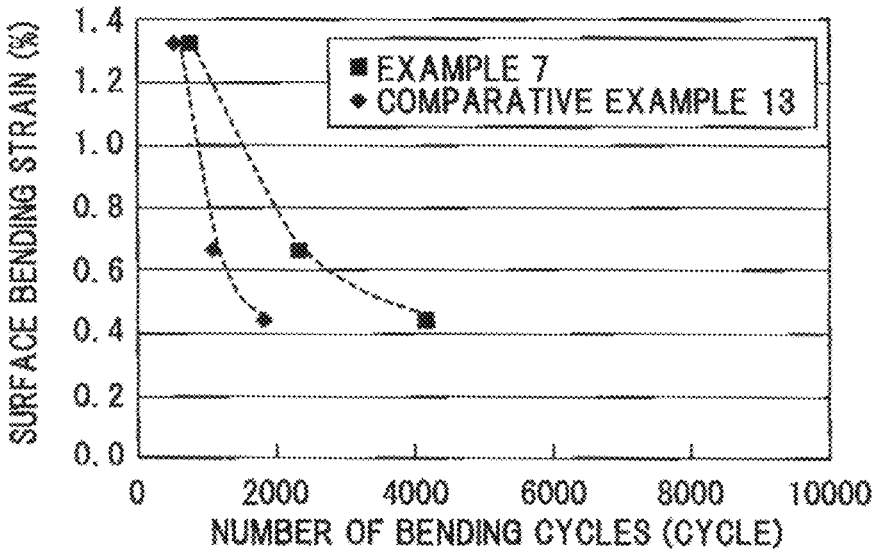
FIG. 8 is a graph showing bending lives of a wire rod in Comparative Example 13 using oxygen-free copper and a wire rod in Example 7 formed using a soft dilute copper alloy wire in which Ti is added to low-oxygen copper, which are measured after annealing treatment at 400° C. for 1 hour.

FIG. 7 schematically shows a bending fatigue test, and FIG. 8 is a graph showing bending lives of a wire rod in Comparative Example 13 using oxygen-free copper and a wire rod in Example 7 formed using a soft dilute copper alloy wire in which Ti is added to low-oxygen copper, which are measured after annealing treatment at 400° C. for 1 hour.

Each sample used here is a 0.26 mm diameter wire rod annealed at the annealing temperature of 400° C. for 1 hour, where the wire rod in Comparative Example 13 has the same element composition as the wire rod in Comparative Example 11 and the wire rod in Example 7 has the same element composition as the wire rod in Example 5.

A bending fatigue test was conducted to measure a bending life. In the bending fatigue test, a load is applied to a sample to impart tension and compression strain to the surface thereof by cyclic bending. In detail, firstly, a sample 20 is fixed to a clamp 12 provided on a bending head 14 and is placed between bending jigs (i.e., rings 10) as shown in (A) of FIG. 7. Then, a load is applied to the sample 20 by a weight 16. Next, the sample 20 is bent by a 90° rotation of the rings 10 as shown in (B) of FIG. 7. This operation generates a compressive strain on a surface of the sample 20 in contact with the ring 10 and a tensile strain on a surface opposite to the surface on which the compressive strain is generated.

After that, the sample 20 returns to the state (A) of FIG. 7 (the state in which the sample 20 is not bent) again. Following this, as shown in (C) of FIG. 7, the sample 20 is bent by a 90° rotation of the rings 10 in a direction opposite to the direction shown in (B) of FIG. 7. This operation generates a compressive strain on a surface of the sample 20 in contact with the ring 10 and a tensile strain on a surface opposite to the surface on which the compressive strain is generated. Then, the sample 20 returns to the state (A) of FIG. 7 again. One bending fatigue cycle (moved from the state (A) to the state (B) of FIG. 7, returned from the state (B) to the state (A), moved from the state (A) to the state (C) and returned from the state (C) to the state (A)) requires 4 seconds.

The surface bending strain is calculated by the formula "Surface bending strain (%)=r/(R+r)×100(%)". Here, "R" is a bending radius of wire (30 mm) and "r" is a radius of wire.

As shown in FIG. 8, the wire rod in Example 7 exhibits higher bending life characteristics than the wire rod in Comparative Example 13.

Figure 9:
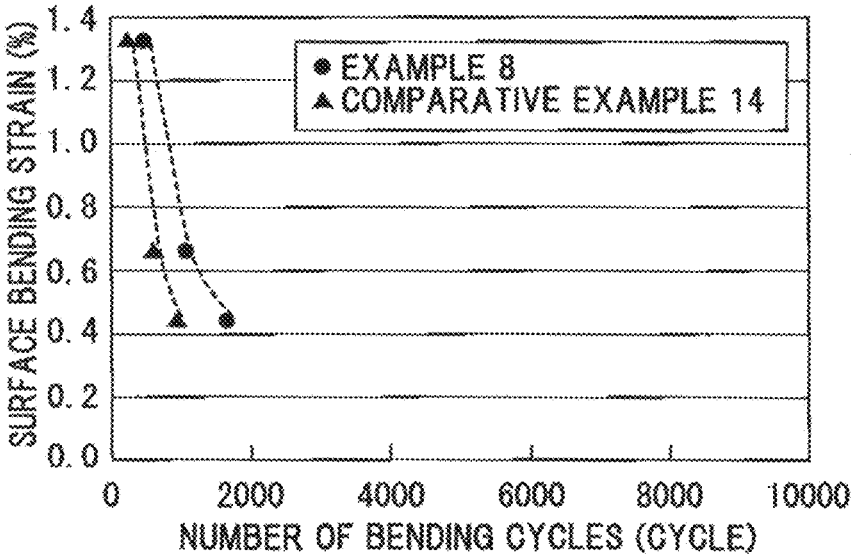
FIG. 9 is a graph showing bending lives of a wire rod in Comparative Example 14 using oxygen-free copper and a wire rod in Example 8 formed using a soft dilute copper alloy wire in which Ti is added to low-oxygen copper, which are measured after annealing treatment at 600° C. for 1 hour.

FIG. 9 is a graph showing bending lives of a wire rod in Comparative Example 14 using oxygen-free copper and a wire rod in Example 8 formed using a soft dilute copper alloy wire in which Ti is added to low-oxygen copper, which are measured after annealing treatment at 600° C. for 1 hour.

Each sample used here is a 0.26 mm diameter wire rod annealed at the annealing temperature of 600° C. for 1 hour, where the wire rod in Comparative Example 14 has the same element composition as the wire rod in Comparative Example 11 and the wire rod in Example 8 has the same element composition as the wire rod in Example 5. In addition, the bending life was measured in the same manner as the measuring method shown in FIG. 8. As a result, the wire rod in Example 8 exhibits higher bending life characteristics than the wire rod in Comparative Example 14.

It is understood that the measurement results of the bending life of the wire rod in Examples 7, 8 and Comparative Example 13 and 14 are caused because the wire rods in Examples 7 and 8 exhibit a greater 0.2% proof stress value than the wire rods in Comparative Examples 13 and 14 under any annealing conditions.

Examination of Crystal Structure of Soft Dilute Copper Alloy Wire

Figure 10:
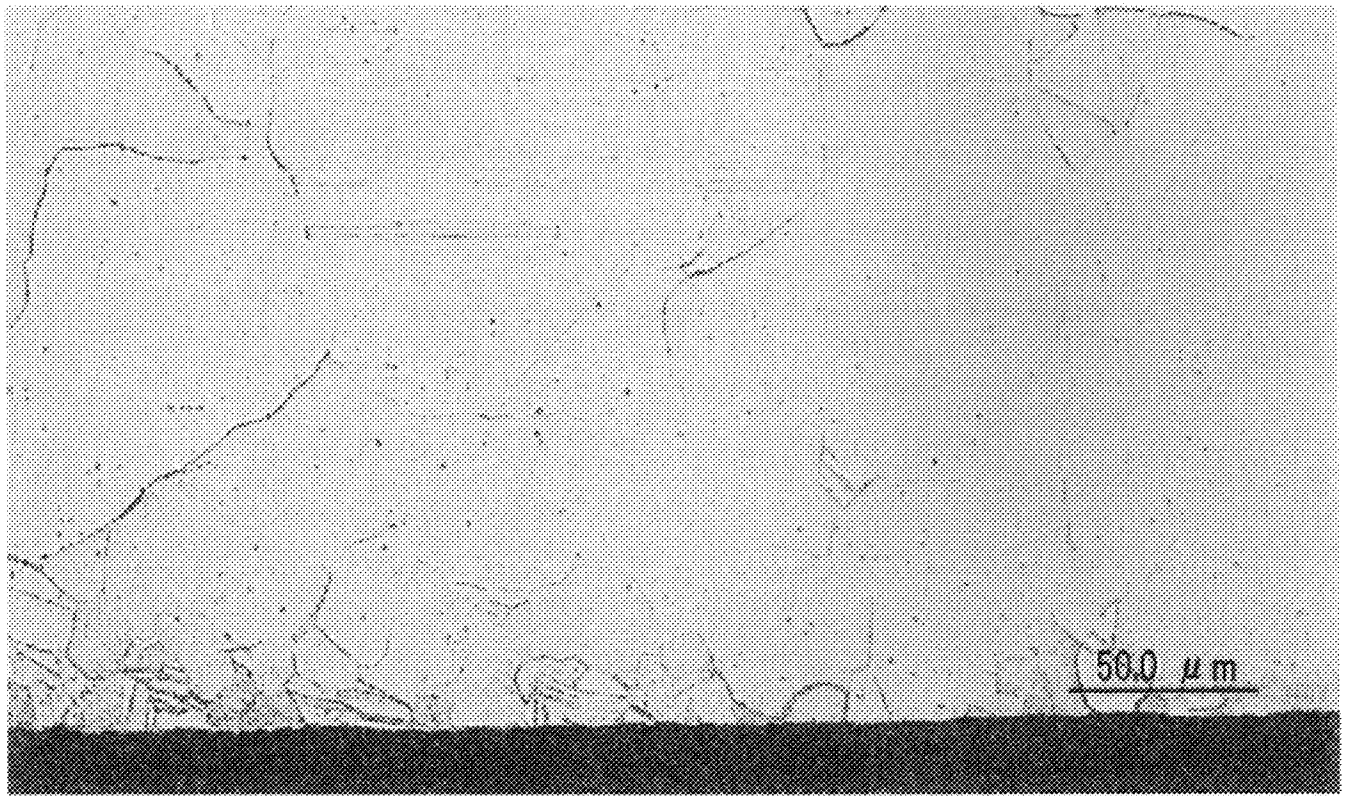
FIG. 10 is a photograph showing a cross section structure across-the-width of a sample in Example 8.
Figure 11:
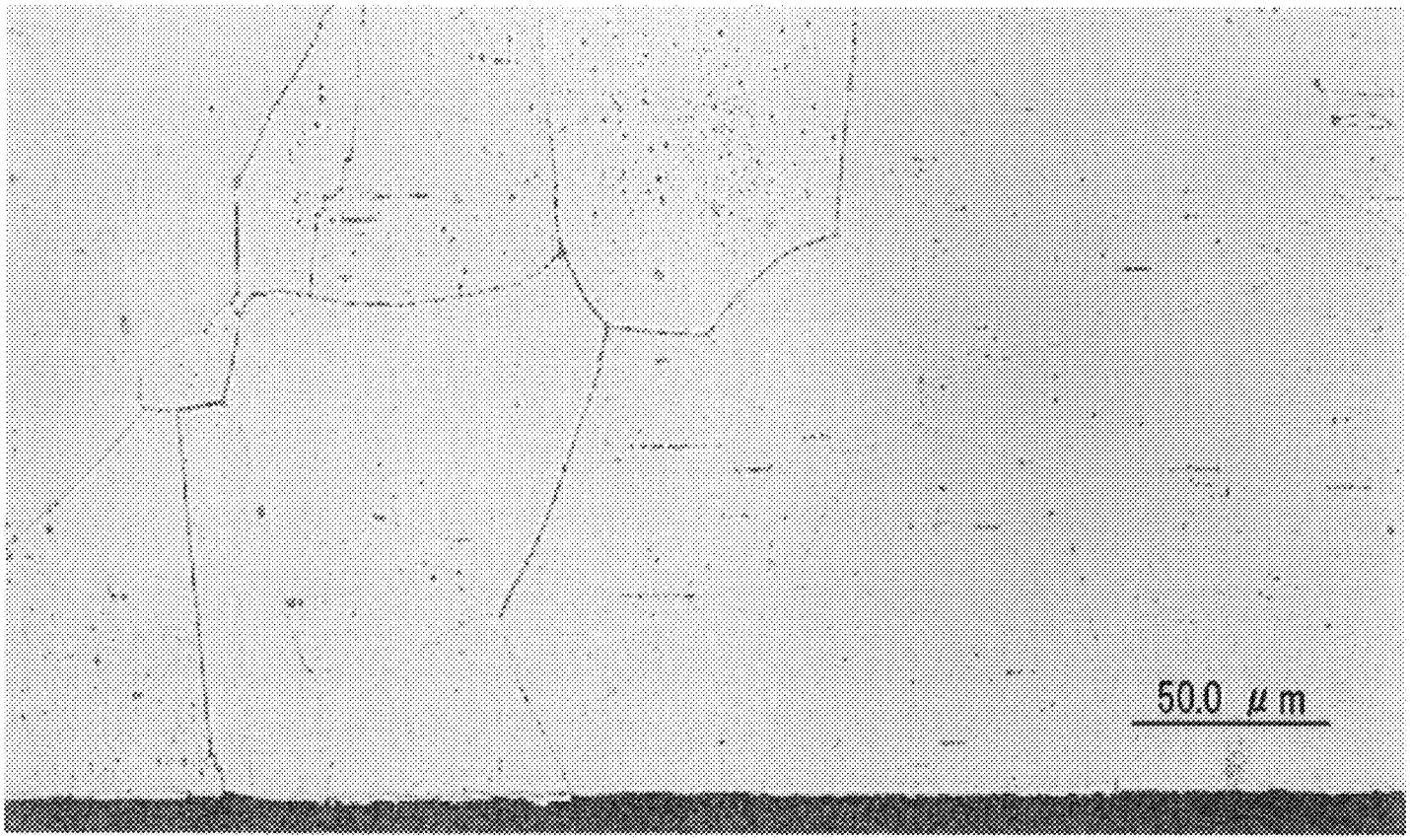
FIG. 11 is a photograph showing a cross section structure across-the-width of a sample in Comparative Example 14.

FIG. 10 shows a cross section structure across-the-width of a sample in Example 8 and FIG. 11 shows a cross section structure across-the-width of a sample in Comparative Example 14.

Referring to FIG. 10, it is found that crystal grains having an equal size all around are uniformly aligned from the surface to the middle portion in the crystal structure of Example 8. On the other hand, the size of crystal grain in the crystal structure of Comparative Example 14 is uneven as a whole and a crystal grain size in a thin layer formed on the sample near a surface thereof in a cross-sectional direction is extremely smaller than that of inner side.

The inventors consider that a fine crystal grain layer appeared as a surface layer, which is not formed in Comparative Example 14, contributes to improve bending characteristics of Example 8.

In general, it is understood that uniformly coarsened crystal grains are formed by recrystallization as is in Comparative Example 14 if annealing treatment is carried out at an annealing temperature of 600° C. for 1 hour. However, a fine crystal grain layer remains as a surface layer in the present example even after the annealing treatment at the annealing temperature of 600° C. for 1 hour. Therefore, it is considered that a soft dilute copper alloy material excellent in bending characteristics is obtained in the present example even though it is a soft copper material.

Then, average crystal grain sizes in the surface layers of the samples in Example 8 and Comparative Example 14 were measured based on the cross-sectional images of the crystal structures shown in FIGS. 10 and 11.

Figure 12:
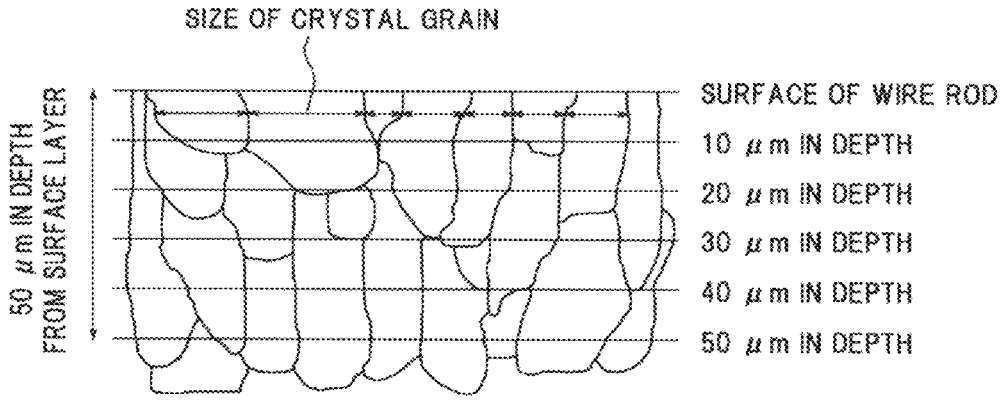
FIG. 12 is a schematic view showing a method of measuring an average crystal grain size in a surface layer.

FIG. 12 schematically shows a method of measuring an average crystal grain size in a surface layer.

A crystal grain size was measured within 1 mm in length from a surface of a widthwise cross section with 0.26 mm diameter up to a depth of 50 μm at intervals of 10 μm in a depth direction as shown in FIG. 12. Then, an average value was calculated from the measured values (the actual measured values) and was defined as an average crystal grain size.

As a result of the measurement, the average crystal grain size in the surface layer of Comparative Example 14 was 50 μm, and is largely different from that in Example 8 which was 10 μm. It is believed that a fine average crystal grain size in the surface layer suppresses development of cracks caused by the bending fatigue test, which extends the bending fatigue life. (Note that, cracks are developed along a crystal grain boundary when the crystal grain size is large. However, the development of cracks is suppressed when the crystal grain size is small since a developing direction of cracks is changed). It is considered that this is the reason why a large difference in the bending characteristics is caused between Comparative Examples and Examples as described above.

Meanwhile, average crystal grain sizes in the surface layers of Example 6 and Comparative Example 12 each having a diameter of 2.6 mm were obtained by measuring crystal grain sizes within 10 mm in length from the surface of a widthwise cross section with 2.6 mm diameter up to a depth of 50 μm in a depth direction.

As a result of the measurement, the average crystal grain size in the surface layer of Comparative Example 12 was 100 μm and that of Example 6 was 20 μm.

In order to achieve the effect of the present example, the upper limit of the average crystal grain size in the surface layer is preferably not more than 20 μm. In addition, considering a limit value for production, the average crystal grain size is preferably not less than 5 μm.

Figure 13:
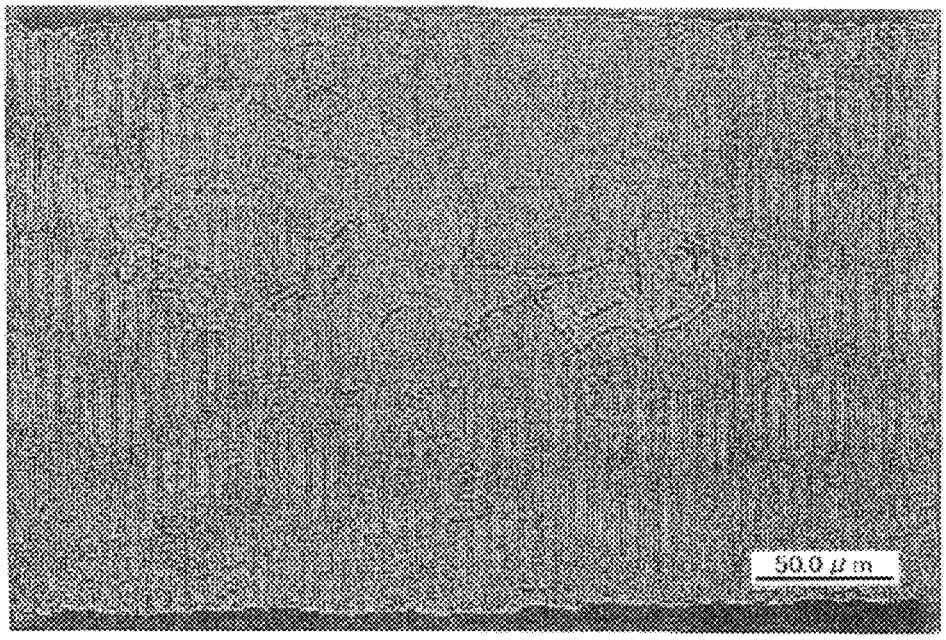
FIG. 13 is a cross sectional view showing a LOC-Ti material in Example.
Figure 14:
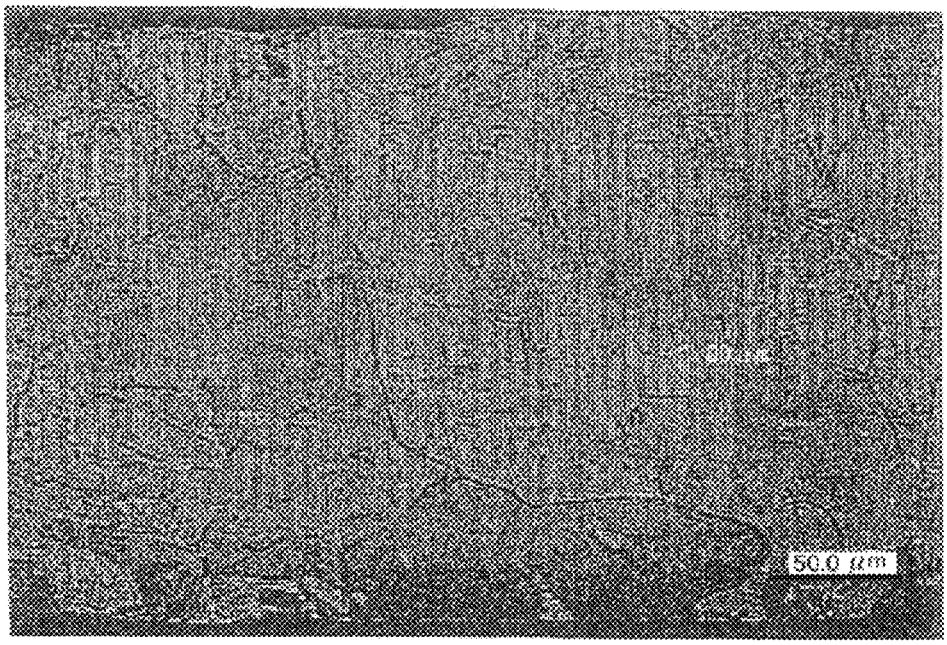
FIG. 14 is a cross sectional view showing OFC in Comparative Example.

FIG. 13 shows a cross section of a LOC-Ti material in Example and FIG. 14 shows a cross section of OFC in Comparative Example.

Use in Speaker Cable

A speaker cable is composed of a conductor and an insulation layer. For example, an outer periphery of a conductor as a twisted copper wire formed by twisting plural 0.26 mm-diameter copper strands (soft dilute copper alloy wires) is coated with a polyethylene insulation layer and two conductors are aligned in parallel, thereby forming a speaker cable. The same material as the material in Example 8 was used for the copper strand.

Here, a method of manufacturing the material described above is as follows. That is, a 8 mm diameter wire rod is made by controlling a molten copper temperature to be 1320° C. and a rolling temperature to be 880 to 550° C., and is then drawn to process into a 2.6 mm diameter material. The 2.6 mm diameter material is drawn to have a 0.26 mm diameter and is then annealed (at 400° C. for 1 hour), thereby obtaining the material described above. Meanwhile, a material, which is made by the same manufacturing method as Example except that a raw material is OFC, was prepared as Comparative Example.

Meanwhile, a speaker cable, in which an outer periphery of a conductor as a twisted copper wire formed by twisting plural 0.26 mm-diameter copper strands is coated with a polyethylene insulation layer and then an outer periphery of two conductors twisted together are coated with a polyethylene jacket, was also made as another embodiment of a speaker cable.

In the above two embodiments, the following effects are obtained when a copper strand having the same alloy composition as that described in Example 7 is used.

1) A conductor formed using a soft dilute copper alloy wire which includes Ti and inevitable impurities as a balance and of which average crystal grain size from a surface of the surface layer up to a depth of 50 μm is not more than 20 μm allows a speaker cable having a conductivity equivalent to 6N copper and flexibility better than 6N copper to be supplied with less cost. That is, the conductor of such a cable has a feature that there are secondary recrystallized grains inside thereof while a crystal grain size on the surface is kept to be small even after the heat treatment at 400° C. for 1 hour. Therefore, it has secondary recrystallized grains inside thereof and is excellent in flexibility even though it is a soft copper wire.

Figure 15:
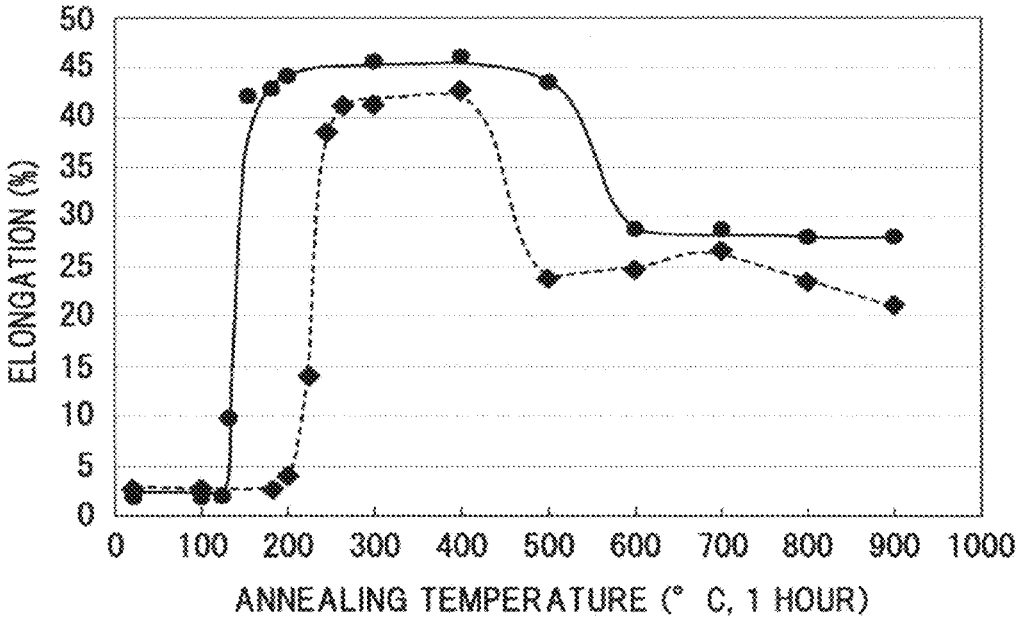
FIG. 15 is a graph showing a relation between elongation and an annealing temperature.

2) This allows a soft copper wire to be easily processed into a twisted wire, etc., and to be elongated more than Comparative Example (OFC) as shown in FIG. 15 while a conventional technique of using as a hard copper wire allows secondary recrystallization but has difficulty to process into a twisted wire, etc., and is likely to cause breakage, therefore, it is possible to provide a cable which is extremely less likely to be broken even if being bent.

Here, FIG. 15 is to make clear a relation between annealing conditions and elongation of material in Example ("○" in FIG. 15) and Comparative Example (OFC, "◇" in FIG. 15). In Example, the same conductor as the conductor shown in the example of the speaker cable is used. As shown in FIG. 15, the elongation under the conditions of the annealing temperature of 400° C. for 1 hour was 45% in Example and 42.5% in Comparative Example, which shows that Example is better in elongation characteristics than in Comparative Example.

3) Meanwhile, referring to FIG. 14, although large crystal grains are observed in Comparative Example (OFC), it is found that the crystal grain structure is not a monocrystalline structure and that a strip crystal structure (twin structure) shown in black in the drawing is scattered inside the crystal grain. Thus, the number of twin crystals per unit area in Example was compared to that in Comparative Example, and the result was 27.6 per 100-μm square in Comparative Example (OFC) and 12.4 per 100-μm square in Example. This shows that the internal crystal grains in Example are enlarged by recrystallization and has fewer twin structures than OFC, hence, the conductor in Example has fewer crystal grain boundaries than the OFC material.

4) Then, the internal crystal size in Example and that in Comparative Example were measured. A section method was used for the measurement. The internal crystal size in Example was 30 μm while that in Comparative Example was 24 μm, and it was thus found that the internal crystal size of the crystal structure is larger in Example than in Comparative Example.

5) The above (3) and (4) show that the crystal structure in Example has fewer crystal grain boundaries and larger internal crystal size than those in Comparative Example, and the conductor excellent for improving the sound and image quality is used in Example.

6) An option to choose a speaker cable having a conductivity equivalent to 6N and being cheaper than 6N can be given to audio enthusiasts or music industry who or which has difficulty to use a 6N speaker cable due to high cost, and a speaker cable excellent in bending characteristics even if repeatedly stretched and wound can be provided to motion-picture industry or outdoor concert industry in which a long speaker cable of several tens meters is used.

Although a speaker cable has been described in Example, it is possible to used for a conductor in another example as follows.

Figure 16:
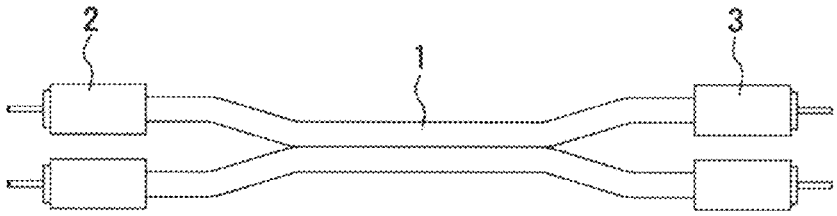
FIG. 16 is a diagram illustrating an audio cable.

FIG. 16 shows an audio cable. An audio cable is used for, e.g., reproducing stereophonic sound from a CD player through an amplifier. The audio cable is composed of two coaxial cables 1, two input pin jacks 2 and two output pin jacks 3.

Figure 17:
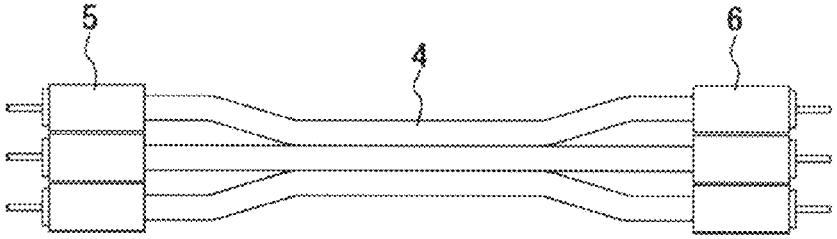
FIG. 17 is a diagram illustrating a video cable.

FIG. 17 shows a video cable. A video cable is used for, e.g., reproducing video image and stereophonic sound from a DVD player or a video cassette recorder on a stereo television. The video cable is composed of three coaxial cables 4, three input pin jacks 5 and three output pin jacks 6. One of the coaxial cables 4 is for visual and the remaining two coaxial cables 4 are for audio.

Figure 18:
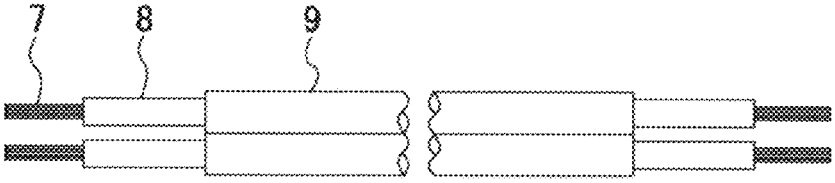
FIG. 18 is a diagram illustrating a speaker cable.

FIG. 18 shows a speaker cable. A speaker cable is used for, e.g., reproducing sound from an amplifier through a speaker. The speaker cable is composed of two cables 8 insulating positive and negative twisted wires 7 and a sheath 9 for coating thereof.

In addition, it is possible to use for an S-terminal video cable, a D-terminal video cable and an HDMI cable.

The conductor is not limited to a twisted wire, and may be a single wire or a bundle wire, or alternatively, may be a sliver-plated twisted copper wire or a twisted wire with enamel coating. In addition, an insulating material as an insulation layer and a jacket is not limited to polyethylene, and for example, a material having a lower dielectric constant than polyethylene is preferably used. In addition, a plating layer may be formed on a surface of the soft dilute copper alloy wire. It is possible to use a plating layer consisting mainly of, e.g., tin, nickel and silver, or so-called Pb-free plating may be used.

Although the embodiment and examples of the invention have been described, the invention according to claims is not to be limited to the above-mentioned embodiment and examples. Further, please note that not all combinations of the features described in the embodiment and examples are not necessary to solve the problem of the invention.

What is claimed is:

1. An audio/video cable, comprising:

a plurality of parallel arranged insulated wires each comprising a copper conductor for transmitting audio/video signals and an insulation layer formed on a periphery thereof, wherein the copper conductor comprises a soft dilute copper alloy material containing pure copper, Ti as an additive element and an inevitable impurity as a balance, wherein the soft dilute copper alloy material comprises a recrystallized structure having a grain size distribution such that crystal grains in a surface layer are smaller than internal crystal grains, wherein the surface layer comprises a crystal structure such that an average crystal grain size from a surface of the surface layer up to a depth of 50 μm toward inside of the soft dilute copper alloy material is not more than 20 μm, wherein the Ti in a form of one of TiO, $TiO_2$, TiS, and Ti—O—S is included in a crystal grain or at a crystal grain boundary of the pure copper, and wherein the soft dilute copper alloy material includes not less than 2 and not more than 12 mass ppm of sulfur, more than 2 mass ppm but not more than 30 mass ppm of oxygen, and not less than 4 and not more than 55 mass ppm of Ti.

2. The audio/video cable according to claim 1, wherein the Ti includes TiO of not more than 200 nm in size, $TiO_2$ of not more than 1000 nm in size, TiS of not more than 200 nm in size, or a compound in a form of Ti—O—S of not more than 300 nm in size.

3. The audio/video cable according to claim 1, wherein an electrical conductivity of the soft dilute copper alloy material is not lower than 102% IACS (International Annealed Copper Standard).

4. The audio/video cable according to claim 3, wherein the soft dilute copper alloy material includes not less than 3 and not more than 12 mass ppm of sulfur, and not less than 4 and not more than 25 mass ppm of Ti.

5. The audio/video cable according to claim 3, wherein the soft dilute copper alloy material has a softening temperature of not more than 148° C.

6. The audio/video cable according to claim 5, wherein the soft dilute copper alloy material includes a dispersed particle size that is not more than 500 nm in not less than 90% of particles.

7. The audio/video cable according to claim 1, wherein the soft dilute copper alloy material includes not less than 3 and not more than 12 mass ppm of sulfur, and not less than 4 and not more than 25 mass ppm of Ti.

8. An audio/video cable, comprising:

a plurality of twisted pair insulated wires each comprising a copper conductor for transmitting audio/video signals and an insulation layer formed on a periphery thereof; and a jacket covering a periphery thereof, wherein the copper conductor comprises a soft dilute copper alloy material containing pure copper, Ti as an additive element and an inevitable impurity as a balance, wherein the soft dilute copper alloy material comprises a recrystallized structure having a grain size distribution such that crystal grains in a surface layer are smaller than internal crystal grains, wherein the surface layer comprises a crystal structure such that an average crystal grain size from a surface of the surface layer up to a depth of 50 μm toward inside of the soft dilute copper alloy material is not more than 20 μm, wherein the Ti in a form of one of TiO, $TiO_2$, TiS, and Ti—O—S is included in a crystal grain or at a crystal grain boundary of the pure copper, and wherein the soft dilute copper alloy material includes not less than 2 and not more than 12 mass ppm of sulfur, more than 2 mass ppm but not more than 30 mass ppm of oxygen, and not less than 4 and not more than 55 mass ppm of Ti.

9. The audio/video cable according to claim 8, wherein the Ti includes TiO of not more than 200 nm in size, $TiO_2$ of not more than 1000 nm in size, TiS of not more than 200 nm in size, or a compound in a form of Ti—O—S of not more than 300 nm in size.

10. The audio/video cable according to claim 8, wherein an electrical conductivity of the soft dilute copper alloy material is not lower than 102% IACS (International Annealed Copper Standard).

11. The audio/video cable according to claim 10, wherein the soft dilute copper alloy material includes not less than 3 and not more than 12 mass ppm of sulfur, and not less than 4 and not more than 25 mass ppm of Ti.

12. The audio/video cable according to claim 10, wherein the soft dilute copper alloy material has a softening temperature of not more than 148° C.

13. The audio/video cable according to claim 12, wherein the soft dilute copper alloy material includes a dispersed particle size that is not more than 500 nm in not less than 90% of particles.

14. The audio/video cable according to claim 2, wherein the soft dilute copper alloy material includes not less than 3 and not more than 12 mass ppm of sulfur, and not less than 4 and not more than 25 mass ppm of Ti.

* * * * *